US006822612B2

(12) United States Patent
Takimoto et al.

(10) Patent No.: US 6,822,612 B2
(45) Date of Patent: Nov. 23, 2004

(54) ANTENNA DEVICE, COMMUNICATION APPARATUS AND RADAR MODULE

(75) Inventors: Yukio Takimoto, Kyoto-fu (JP); Toru Tanizaki, Kyoto-fu (JP); Fuminori Nakamura, Kyoto-fu (JP); Ikuo Takakuwa, Kyoto-fu (JP); Nobumasa Kitamori, Kyoto-fu (JP)

(73) Assignee: Murata Manufacturing Co. Ltd (JP)

( * ) Notice: Subject to any disclaimer, the term of this patent is extended or adjusted under 35 U.S.C. 154(b) by 12 days.

(21) Appl. No.: 09/968,414

(22) Filed: Sep. 26, 2001

(65) Prior Publication Data

US 2002/0067314 A1 Jun. 6, 2002

(30) Foreign Application Priority Data

Sep. 27, 2000 (JP) ..... 2000-295204

(51) Int. Cl.[7] ..... H01Q 1/32; H01Q 3/02
(52) U.S. Cl. ..... 343/713; 343/754
(58) Field of Search ..... 343/711–713, 761, 343/909, 753, 754; 342/70

(56) References Cited

U.S. PATENT DOCUMENTS 2,576,181 A * 11/1951 Iams ..... 343/754
2,720,589 A * 10/1955 Proctor ..... 343/754
4,210,357 A * 7/1980 Adachi ..... 343/713
5,926,127 A 7/1999 Schmidt et al.

FOREIGN PATENT DOCUMENTS

| | | |
|---|---|---|
| EP | 0 498 524 A2 | 1/1992 |
| EP | 0 969 548 A2 | 1/2000 |
| JP | 10027299 | 1/1998 |
| JP | 10142324 | 5/1998 |
| JP | 10200331 | 7/1998 |
| WO | WO 99/42856 | 8/1999 |

* cited by examiner

*Primary Examiner*—Michael C. Wimer
(74) *Attorney, Agent, or Firm*—Dickstein, Shapiro, Morin & Oshinsky, LLP.

(57) ABSTRACT

An antenna device capable of increasing the speed of scanning as well as extending the scanning angular range of a beam to obtain a high gain. A radar module and a communication apparatus having enhanced detection capabilities obtainable by using the antenna device. In the antenna device, electromagnetic waves radiated from a primary radiator are transmitted to a plurality of openings, e.g., dielectric lenses and/or reflectors or optical transmitters. The dielectric openings are arranged on a fixed portion and the primary radiator is arranged on a moving portion. The moving portion is displaced relatively with respect to the fixed portion. This arrangement enables the selection of an opening used for receiving each of the electromagnetic waves from the primary radiator to change the direction of the beam.

9 Claims, 11 Drawing Sheets

ANTENNA DEVICE, COMMUNICATION APPARATUS AND RADAR MODULE

BACKGROUND OF THE INVENTION

1. Field of the Invention

The present invention relates to antenna devices with primary radiators and openings, used for transmission in millimeter-wave bands. The invention also relates to communication apparatus and radar modules incorporating the antenna devices.

2. Description of the Related Art

In a conventional vehicle radar module utilizing a millimeter wave band or the like, a radar beam having high directivity is emitted in the forward and backward directions of the vehicle. Then, the radar module receives waves reflected by targets such as other vehicles running before and after the vehicle to detect distances from the targets and the relative speed of the vehicle with respect to the targets based on the time lag and the frequency difference between transmitted and received signals. In such a millimeter-wave radar module, when the angular range of detection is narrow, the beams of transmitted and received waves will be formed in fixed directions. However, when the angular range of the detection is wide and when a high gain needs to be maintained without deteriorating the resolution obtained in the detecting angular direction, the directions of the beams formed by the transmitted and received waves need to be changed while maintaining high beam directivities. Hereinafter, changing the beam directions will be referred to as beam scanning.

In an aperture antenna including a dielectric lens and a primary radiator, beam scanning is performed by changing the position of the primary radiator relatively with respect to the dielectric lens. As one example, there is known an antenna device described in (1) Japanese Unexamined Patent Application Publication No. 10-200331. In this case, as shown in FIG. 16, there is provided a single antenna device having a dielectric lens 25 and a primary radiator 1. The direction of a beam is changed by relatively changing the position of the primary radiator 1 with respect to the dielectric lens 25. In FIG. 16, the reference numerals 1*a*, 1*b*, and 1*c* simultaneously represent three positions of the single primary radiator obtained when beam scanning is performed. When the primary radiator is in the position 1*a*, a beam is formed as shown at Ba. When the primary radiator is in the position 1*b*, a beam is formed as shown at Bb. In addition, a beam as shown at Bc is formed when the primary radiator is in the position 1*c*.

Furthermore, in (2) Japanese Unexamined Patent Application Publication No. 10-27299, there is described a vehicle radar module detecting objects by switching a plurality of antennas having different beam widths.

Besides, (3) Japanese Unexamined Patent Application Publication No. 10-142324 provides a radar module in which five reception beams are arranged in the beam-width range of a transmission antenna.

On the other hand, in the device (1), when the displacement of the primary radiator is increased in order to perform beam scanning over a wide angular range by using the single dielectric lens and the single primary radiator, the position of the primary radiator significantly deviates from the most suitable position for the dielectric lens and the gain of the antenna is reduced, thereby resulting in significant deterioration in the side-lobe level (characteristics). As a result, since the beam-scanning angle cannot be changed widely, scanning cannot be performed in a wide angular range. For example, since the beam cannot be oriented in a range over ±60°, it is difficult to detect objects over a wide range.

The radar module (2) has no function for detecting angular information on the direction of a beam. Thus, the directional information of an obstacle cannot be obtained. Additionally, there is a problem in that the number of antennas including primary radiators and lenses needs to coincide with the number of beams. Furthermore, the publication (2) describes only the concept of the module and does not clarify the realizing method.

In the radar module (3), the scanning angle is determined according to the adjustment between the direction of a beam emitted from the transmission antenna and the beam width of a reception antenna. Consequently, the wider the scanning angle, the broader the width of the transmission beam. However, it is difficult to greatly broaden the width of the transmission beam. Even if it can be broadened, that results in reduction in power density, whereby a detectable distance is reduced.

SUMMARY OF THE INVENTION

Accordingly, it is an object of the present invention to provide a high-gain antenna device capable of broadening the range of beam scanning and easily increasing the speed of scanning. It is another object of the invention to provide a radar module and a communication apparatus incorporating the antenna device, which have high detection capabilities.

According to a first aspect of the invention, there is provided an antenna device including a primary radiator arranged on a moving portion, a plurality of openings arranged on a fixed portion to receive electromagnetic waves radiated from the primary radiator to control the directivities of generated beams, and a unit for relatively displacing the moving portion with respect to the fixed portion to select each opening appropriate for primarily receiving each of the electromagnetic waves and to change the directions of the beams.

With this arrangement, even with the use of the single primary radiator, high-speed beam scanning can be performed over a wide angular range.

In addition, in this antenna, the plurality of openings may be formed by dielectric lenses. As a result, the entire structure of the antenna device can be simplified, thereby facilitating the design of the antenna device.

In addition, in this antenna, the openings may be formed by dielectric lenses and either reflectors or optical transmitters arranged between the dielectric lenses and the primary radiator. With this arrangement, the beam-scanning angle with respect to the displacement of the primary radiator can easily be broadened and the speed of scanning can be increased.

In addition, the antenna device may further include a unit for detecting the direction of the beam emitted from each of the openings. In other words, when beam scanning is performed with each of the plurality of openings, the direction (angular information) of each beam is detected. As a result, while using the plurality of openings, the beam can be oriented in an arbitrary direction.

In addition, the antenna device may further include a directional coupler formed by coupling a line arranged on the fixed portion to a line arranged on the moving portion and coupled to the primary radiator. This arrangement facilitates coupling between the line of the fixed portion and the line of the moving portion.

In addition, the lines arranged on the fixed portion and the moving portion may be nonradiative dielectric lines. As a result, signal transmission loss caused in a millimeter wave band can be reduced, and coupling with the primary radiator can be facilitated.

Furthermore, the degree of coupling between an input side and an output side in the directional coupler may be substantially 0 dB. As a result, insertion loss caused by the directional coupler between the line of the fixed portion and the line of the moving portion can be suppressed, thereby increasing output power.

Furthermore, the antenna device may further include shielding members arranged for shielding at least two predetermined openings from the rest of the plurality of openings. With this arrangement, even when the entire antenna device is made compact, electromagnetic waves from the primary radiator are emitted only to predetermined openings, selectively.

Furthermore, in this antenna device, a line connecting the centers of the openings may be not parallel to a direction in which the primary radiator is displaced so that the direction of the beam is three-dimensionally changed by linearly displacing the moving portion. This arrangement enables the three-dimensional beam scanning.

Furthermore, of the plurality of openings, the central opening may be larger than the remaining openings. With this arrangement, the width of a beam in the central direction is narrowed and the beam widths in directions away from the center are broadened.

Furthermore, in this antenna device, the dielectric lenses may be integrally formed over the plurality of openings. This arrangement facilitates the assembly of dielectric lenses and improves the directional accuracy of each dielectric lens.

According to a second aspect of the invention, there is provided a communication apparatus including the antenna device according to the first aspect, a transmission circuit for outputting a transmission signal to the antenna device, and a reception circuit for receiving a reception signal from the antenna device. This arrangement enables communications performing beam scanning over a wide angular range.

Furthermore, according to a third aspect of the invention, there is provided a radar module including the antenna device according to the first aspect and a unit for outputting a transmission signal to the antenna device and receiving a reception signal from the antenna device to detect an object reflecting electromagnetic waves sent from the antenna device. With this arrangement, high-speed detection of targeted objects can be performed over a wide angular range.

Furthermore, the radar module may further include a unit for controlling the displacement of the moving portion in such a manner that when the speed of a moving object incorporating the radar module is higher than a predetermined speed, the ratio of a time in which the electromagnetic wave radiated from the primary radiator is transmitted to an opening ready for a direction in which the moving object travels, of the plurality of openings, is greater than the ratio of a time in which the electromagnetic wave is transmitted to each of the remaining openings. With this arrangement, intensive detection can be made over a beam-scanning angular range according to the speed of the moving object.

BRIEF DESCRIPTION OF THE DRAWING(S)

DETAILED DESCRIPTION OF EMBODIMENTS OF THE INVENTION

Figure 1:
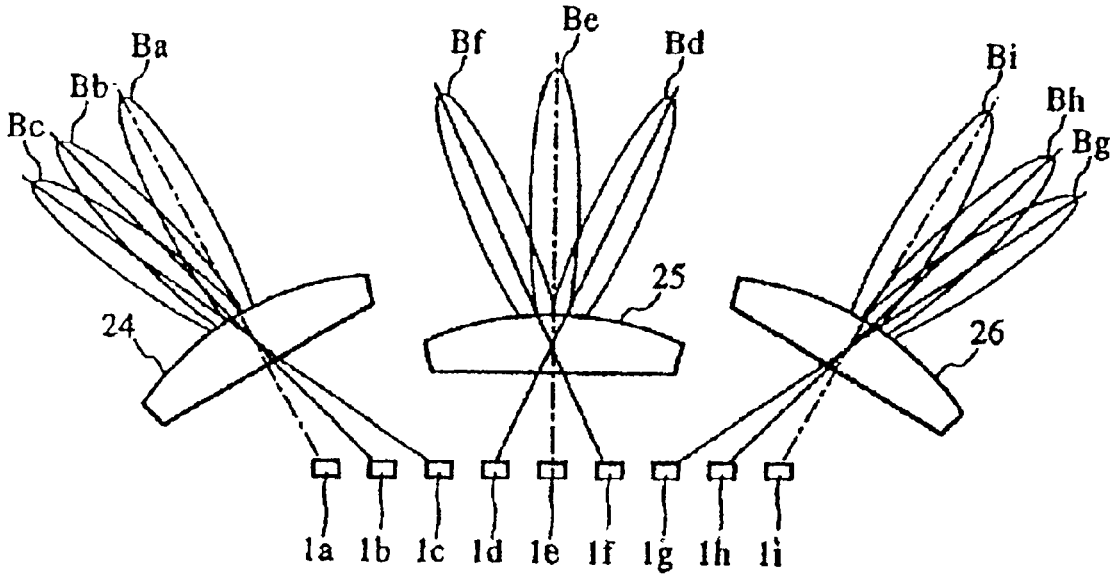
FIG. 1 illustrates an antenna device according to a first embodiment of the present invention and the positional relationships between dielectric lenses and a primary radiator incorporated in the antenna device.
Figure 2A:
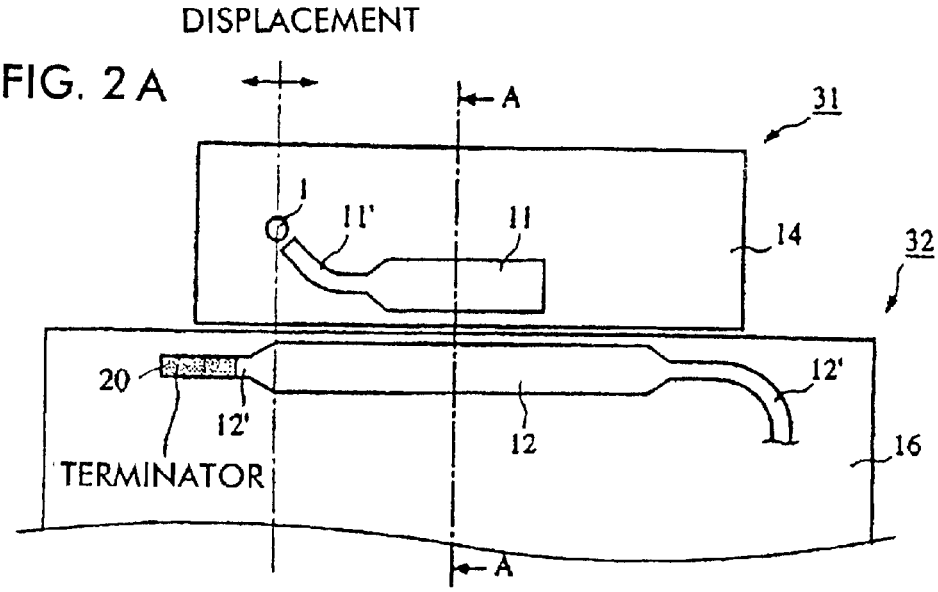
FIGS. 2A to 2C illustrate a directional coupler and the primary radiator incorporated in the antenna device.
Figure 2B:
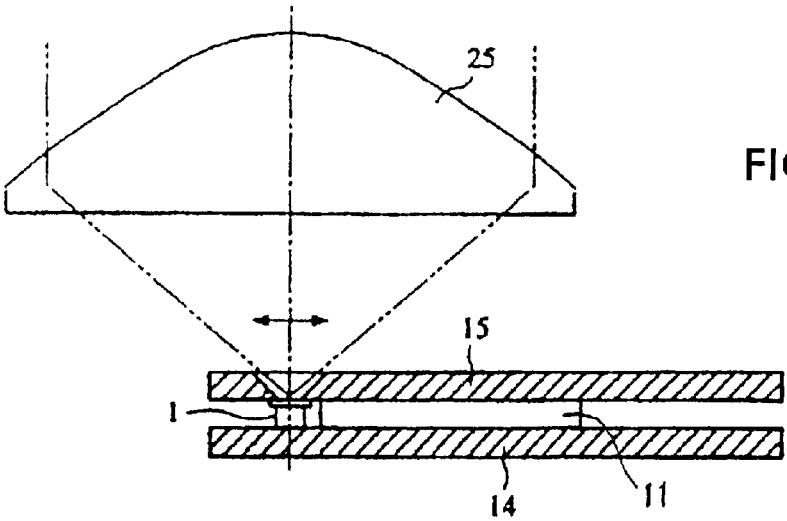
Figure 2C:
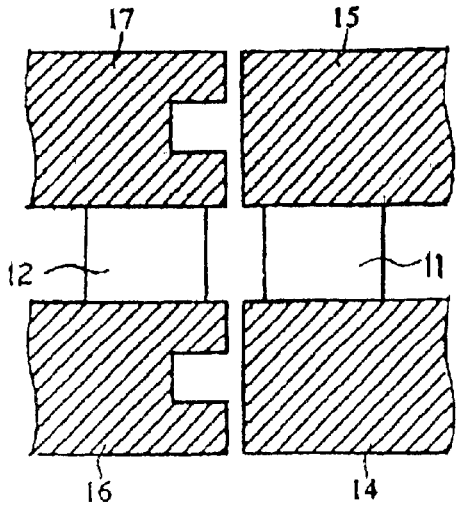
Figure 3:
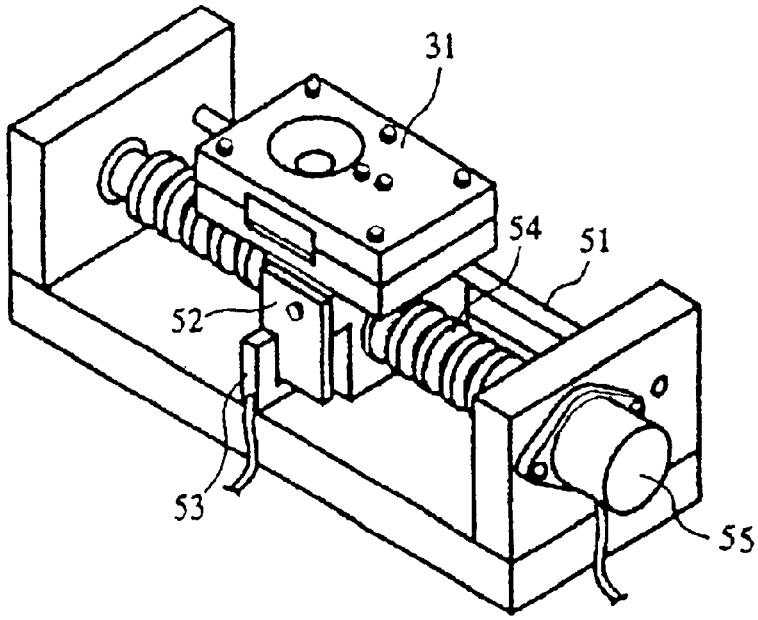
FIG. 3 is a perspective view of a driving mechanism of a moving portion incorporated in the antenna device.

With reference to FIGS. 1 to 3, a description will be given of the structure of an antenna device according to a first embodiment of the present invention.

FIG. 1 illustrates the main part of the antenna device and an example of the displacement of a primary radiator obtained when performing beam scanning. Actually, the antenna device has a single primary radiator. The reference numerals 1*a* to 1*i* shown in FIG. 1 indicate the positions of a primary radiator 1 when beam scanning is performed. As will be described below, a primary radiator 1 is displaced with a mechanism in which a rotary motor or a linear motor is used as a driving source. The reference characters Ba to Bi represent the directional patterns of the antenna obtained when the primary radiator 1 is in the positions 1*a* to 1*i*. The patterns will simply be referred to as beams below.

The reference numerals 24, 25, and 26 denote dielectric lenses converging electromagnetic waves whose radiation intensities are distributed in a relatively wide angular range from the primary radiator 1 to form sharp beams. For example, the central dielectric lens 25 is used to perform beam scanning in a predetermined angular range including the front and right-and-left directions when a radar module having the antenna device is mounted in a vehicle. The dielectric lens 24 is used to perform beam scanning in a predetermined angular range from the front to the left direction. Additionally, the dielectric lens 26 is used to perform beam scanning in a predetermined angular range from the front to the right direction. In other words, when the primary radiator 1 is in the position 1*e*, the beam Be is oriented in the front direction. When the primary radiator 1 is in each of the positions 1*d* and 1*f*, a beam shown by each of symbol Bd and Bf is oriented in a slanting direction from the center Be. The direction of the beam changes in this manner. Thus, by displacing the primary radiator 1 in the above range, beam scanning can be performed in the predetermined angular range from the front to the right and left directions. Furthermore, when the primary radiator 1 is in the position 1*h*, the beam is oriented in the right slanting direction, as shown by Bh. When the primary radiator 1 is in the positions shown by 1*g* and 1*i*, the beam is oriented in each of the right and left directions from the center Bh, as shown by symbols Bg and Bi. Thus, by displacing the primary radiator in this range, beam scanning can be performed in the predetermined angular range in the right direction. Similarly, when the primary radiator 1 is in the position 1*b*, the beam is oriented in the left slanting direction as shown by Bb, and when the primary radiator 1 is in the positions 1*a* and 1*c*, the beam is oriented in each of the right and left directions from the center Bb, as shown by Ba and Bc. Thus, by displacing the primary radiator in this range, beam scanning can be performed in the predetermined angular range in the left direction.

The primary radiator 1 does not always need to be displaced between the position 1*a* and the position 1*i*. For example, after a few times of displacement back and forth between 1*a* and 1*c*, the primary radiator 1 may be displaced back and forth between 1*d* and 1*f* a few times, and then may be a few times repeatedly positioned back and forth between 1*g* and 1*i*.

FIGS. 2A to 2C show the relationship between the primary radiator 1 and the dielectric lenses and the structure of a directional coupler formed by NRD guides, which will be described below. FIG. 2A shows a top view of each of the NRD guides, in which an upper conductive plate is removed. FIG. 2B shows a sectional view taken along a surface passing the primary radiator 1, and FIG. 2C shows a sectional view along the line A—A shown in FIG. 2A.

In FIG. 2A, the reference numeral 32 denotes a fixed portion and the reference numeral 31 denotes a moving portion. The moving portion 31 is displaced in the direction of the arrow relatively with respect to the fixed portion 32. In the moving portion 31, the reference numeral 14 denotes a lower conductive plate and reference 11 denotes a dielectric strip. Between the lower conductive plate 14 and an upper conductive plate 15 there is arranged the dielectric strip 11 to form a first nonradiative dielectric waveguide (hereinafter referred to as a "NRD guide"). In the fixed portion 32, the reference numeral 16 denotes a lower conductive plate and the reference numeral 12 denotes a dielectric strip. Between the lower conductive plate 16 and an upper conductive plate 17 there is arranged the dielectric strip 12 to form a second NRD guide. See FIGS. 2B and 2C.

End faces of the conductive plates of the first and second NRD guides are not in contact with each other and are arranged at a predetermined distance therebetween. The dielectric strip 11 forming the first NRD guide is arranged in parallel and adjacent to the dielectric strip 12 forming the second NRD guide near the end faces of the conductive plates 14 and 16. This arrangement enables the formation of a directional coupler composed of the first and second NRD guides. The coupling length ratio between the dielectric strip 11 and the dielectric strip 12 is set such that the degree of coupling between the two NRD guides is substantially 0 dB.

In FIG. 2A, dielectric strips 11' and 12' and grooves are formed. The dielectric strips are fitted into the grooves and the upper and lower conductive plates sandwich the dielectric strips to constitute NRD guides ("hyper NRD guides"), each of which transmits in a single mode, the LSM01 mode.

The primary radiator 1 formed by a cylindrical dielectric resonator is arranged at an end of the dielectric strip 11' of the moving portion 31. As an alternative to a dielectric resonator, for example, the primary radiator 1 may be formed by a waveguide-like component. As shown in FIG. 2B, the upper conductive plate 15 has a horn-like tapered opening. The opening is coaxial with the primary radiator 1. Between the primary radiator 1 and the opening there is interposed a slit plate, which is a conductive plate with a slit. With this arrangement, electromagnetic waves propagate through the inside of the dielectric strip 11' in an LSM mode having an electric field component at a right angle to the lengthwise direction of the dielectric strip 11' in a direction parallel to the conductive plates 14 and 15 and having a magnetic field component in a direction perpendicular to the conductive plates 14 and 15. Then, the dielectric strip 11' and the primary radiator 1 are electromagnetically coupled with each other, whereby an HE111 mode having an electric field component in the same direction as the electric field of the dielectric strip 11' is generated in the primary radiator 1. After that, linearly polarized electromagnetic waves are radiated in the direction perpendicular to the conductive plate 14 via the opening. The dielectric lens 25 converges the radiated waves to form a predetermined beam. In contrast, when electromagnetic waves are emitted from the opening via the dielectric lens, the primary radiator 1 is excited in the HE111 mode and the electromagnetic waves are thereby propagated in the LSM mode through the dielectric strip 11' to be coupled with the primary radiator 1.

A terminator 20 is arranged at one end of the dielectric strip 12' of the fixed portion 32. With the structure described above, a transmission signal is input to a hyper NRD guide formed by the remaining dielectric strip 12' to output a reception signal.

FIG. 3 shows a perspective view of a driving unit of the moving portion. In FIG. 3, the reference numeral 54 denotes a feed screw. One end of the feed screw 54 is rotatably attached to a frame via a bearing. The other end of the feed screw 54 is connected to the axis of a pulse motor 55 securely screwed to the frame. The frame has a feed guide 51 positioned in parallel to the feed screw 54. A nut portion screwed on the feed screw 54 is slidably attached to the feed guide 51. The moving portion 31 having the primary radiator is securely screwed on the nut portion. Additionally, a shade 52 is attached to the nut portion. The frame has a photo interrupter 53. The shade 52 passes through the optical axis of the photo interrupter 53.

The feed-screw system is basically under an open-loop control, since the moving portion 31 is displaced to a predetermined position based on the number of pulses applied to the pulse motor 55. In other words, a CPU controlling the pulses of the pulse motor applies a predetermined number of pulses to the pulse motor to determine the position of the moving portion. At the same time, since the number of pulses representing the current position of the moving portion is counted by a memory or a register, the position of the moving portion is indirectly detected. When the pulse motor fails to run in order or immediately after power is turned on, the position of the moving portion 31 cannot be detected. In this case, the shade 52 and the photo interrupter 53 are used to detect it. The direction of a beam is detected by using the number of pulses applied to the pulse motor 55 according to the position of the moving portion 31, that is, from the time in which the moving portion 31 is in its home position.

In the above embodiment, although the rotary motor displaces the moving portion, a linear voice coil motor may be used to displace the moving portion. In this case, a sensor is arranged to optically detect the position of the moving portion and the motor is driven in such a manner that the moving portion 31 is in a predetermined position.

Figure 4:
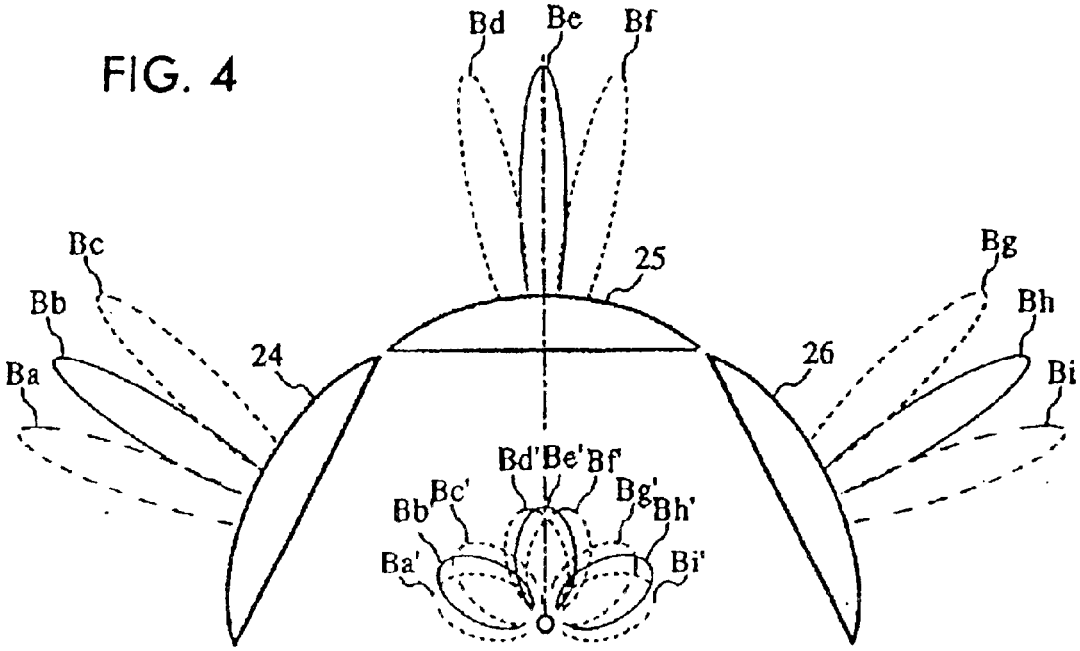
FIG. 4 illustrates an antenna device according to a second embodiment of the invention and the positional relationships between dielectric lenses and a primary radiator incorporated in the antenna device.

Next, an antenna device according to a second embodiment of the invention will be described with reference to FIG. 4.

In the first embodiment, in the linear displacement of the primary radiator, by geometrically changing the position of the primary radiator with respect to the center of each of the dielectric lenses, the direction in which a beam is oriented is changed. However, in the embodiment shown in FIG. 4, the primary radiator 1 is rotationally displaced. In other words, for example, when the radiation pattern (hereinafter referred to as a radiated beam) of an electromagnetic wave radiated from the primary radiator 1 is represented by Be', the dielectric lens 25 converges the radiated beam to form a beam Be in the forward direction. When the primary radiator 1 rotates at a predetermined angle in a clock-wise direction in the figure and a beam radiated from the primary radiator is represented by Bf', a beam radiated in the forward direction via the dielectric lens 25 is represented by Bf. Specifically, even though the primary radiator 1 is positioned near the focal point of the dielectric lens 25, the intensity distribution of the electromagnetic waves emitted to the dielectric lens 25 from the primary radiator 1 is oriented in the right direction and the intensity distribution of electromagnetic waves radiated in the forward direction via the dielectric lens 25 is also oriented in the right direction. Consequently, the center of the beam is oriented in the right direction.

When the beam radiated from the primary radiator 1 is represented by Bd', the beam transmitted through the dielectric lens 25 is represented by Bd. When further rotary displacement of the primary radiator 1 occurs and, for example, when the radiated beam is represented by Bh', the beam transmitted through the dielectric lens 26 is formed into a beam Bh. When the beam radiated from the primary radiator 1 is represented by Bg', the beam transmitted through the dielectric lens 26*a* is formed into a beam Bg. Similarly, when the beam radiated from the primary radiator 1 is Bi', a beam Bi is formed by the beam Bi' transmitted through the dielectric lens 26. In addition, when the beam radiated from the primary radiator 1 is represented by each of Ba', Bb', and Bc' and transmitted through the dielectric lens 24, beams Ba, Bb, and Bc are formed.

In the above manner, the dielectric lens is set substantially in the central direction of the scanning angular range of a beam emitted to each dielectric lens so that the direction of the beam radiated from the primary radiator is changed. As a result, the expansion of a beam and the deterioration of side lobes due to aberration can be prevented, thereby maintaining a high gain over a wide angular range.

Figure 5A:
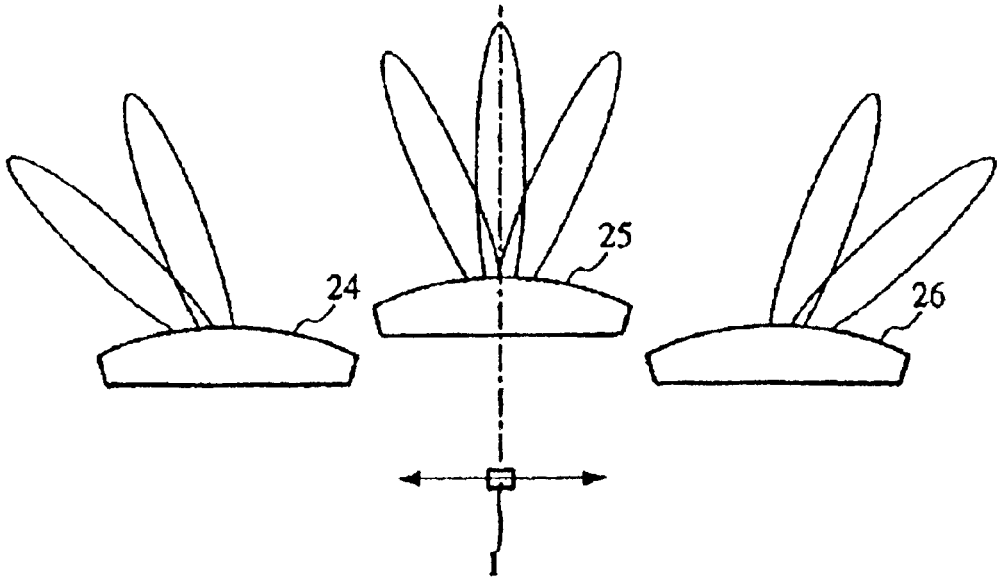
FIGS. 5A and 5B illustrate an antenna device according to a third embodiment of the invention.
Figure 5B:
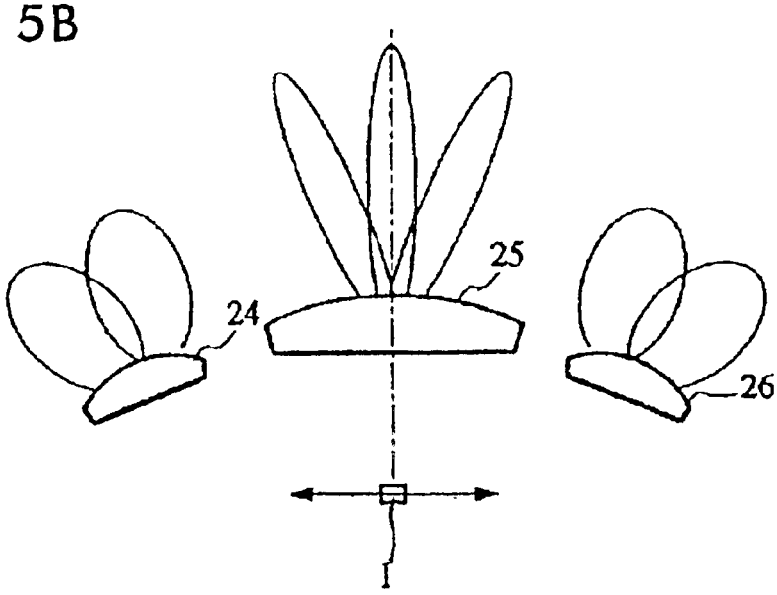

Next, an antenna device according to a third embodiment of the invention will be described with reference to FIGS. 5A and 5B.

In each of the first and second embodiments, the dielectric lenses placed on the right and left are arranged in such a manner that the central axes of the three dielectric lenses pass near the center of the scanning range of the primary radiator or near the position of the primary radiator. However, as shown in FIG. 5A, the dielectric lenses may be arranged in such a manner that the central axes of the dielectric lenses 24, 25, and 26 are parallel to each other.

In addition, in each of the first and second embodiments, the three dielectric lenses have substantially equal aperture sizes. However, as shown in FIG. 5B, for example, the aperture or opening of the dielectric lens 25 in the forward direction may be larger than the apertures of the remaining dielectric lenses 24 and 26. In this manner, by making the aperture of the dielectric lens 25 used for forming a beam in the forward direction larger, when the antenna device is applied to a radar module, the gain and resolution obtained in the forward direction can be increased, whereby more distant detection in the forward direction can be made, which is usually considered to be an important function. When making the apertures of the dielectric lenses arranged for the right and left slanting directions smaller, the widths of formed beams are broadened. However, in this case, as compared with the detection made in the forward direction, it is usually a shorter distant detection. As a result, since the required resolution is not very high, there is no problem with the increase in the beam width. Therefore, the antenna device can have capabilities according to its directivity and can be made compact, enabling beam scanning over a wide angular range.

Next, an antenna device according to a fourth embodiment of the invention will be described with reference to FIG. 6.

In each of the first to third embodiments, the openings are formed only by the dielectric lenses. However, in the antenna device shown in FIG. 6, reflecting mirrors as reflectors are used together with dielectric lenses. In FIG. 6, the reference numerals 34 and 36 denote offset parabolic reflecting mirrors. The axis of the parabola (rotary paraboloid) is outwardly oriented at a predetermined angle with respect to the forward direction. In FIG. 6, the reflecting mirror 34 is used to form a beam in the left slanting direction. When a beam radiated from the primary radiator 1 is Ba', a beam is formed in a direction indicated by an arrow on the left side in the figure. When rotationally displacing the primary radiator 1 and moving the central axis of the beam Ba' radiated from the primary radiator 1 to the right and left at a predetermined angle, the direction of a beam reflected and converged by the reflecting mirror 34 also moves to the right and left at the predetermined angle. Similarly, the reflecting mirror 36 is used to form a beam in the right slanting direction in the figure. When a beam radiated from the primary radiator 1 is Bc', a beam is formed in a direction indicated by an arrow on the right side in the figure. With the rotational displacement of the primary radiator 1, by moving the central axis of the beam Bc' radiated from the primary radiator 1 to the right and left at a predetermined angle, the direction of a beam reflected and converged by the reflecting mirror 36 is also oriented to the right and left at the predetermined angle.

Figure 6:
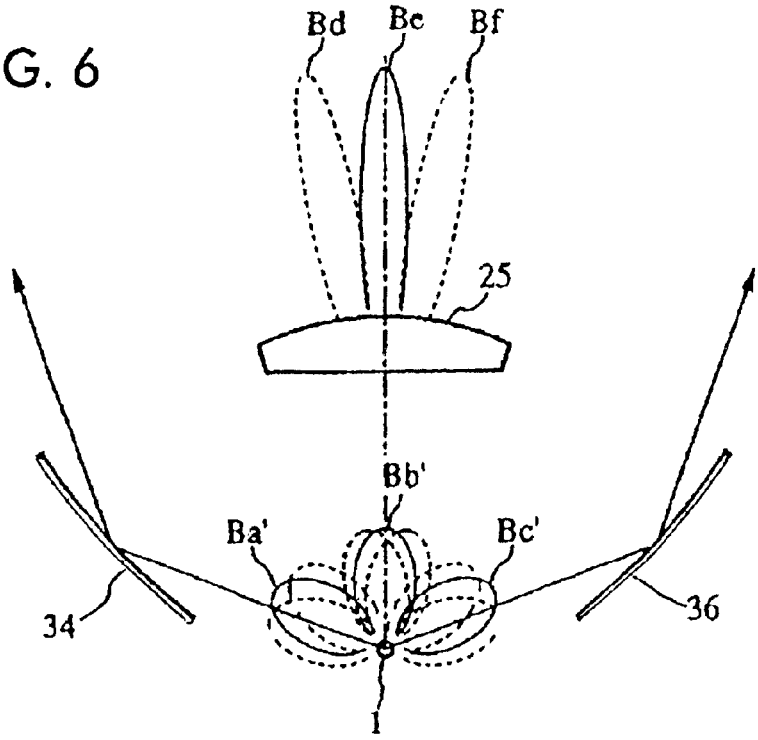
FIG. 6 illustrates an antenna device according to a fourth embodiment of the invention.

In FIG. 6, the reference numeral 25 denotes a dielectric lens used to form a beam in the forward direction. Specifically, when a beam Bb' radiated from the primary radiator 1 is emitted to the dielectric lens 25, a beam is formed in the forward direction. Furthermore, as in the case shown in FIG. 4, when the primary radiator 1 is displaced rotationally with respect to the forward direction as the center at the predetermined angle, a beam formed by transmitting through the dielectric lens 25 results in orienting in the right and left directions at the predetermined angle.

In this manner, in the forward direction and its proximity, the beam width is narrowed to improve the resolution and obtain a high gain. In addition, with the use of the reflecting mirrors, beam scanning can be made in the lateral slanting directions over a wide angular range.

Figure 14:
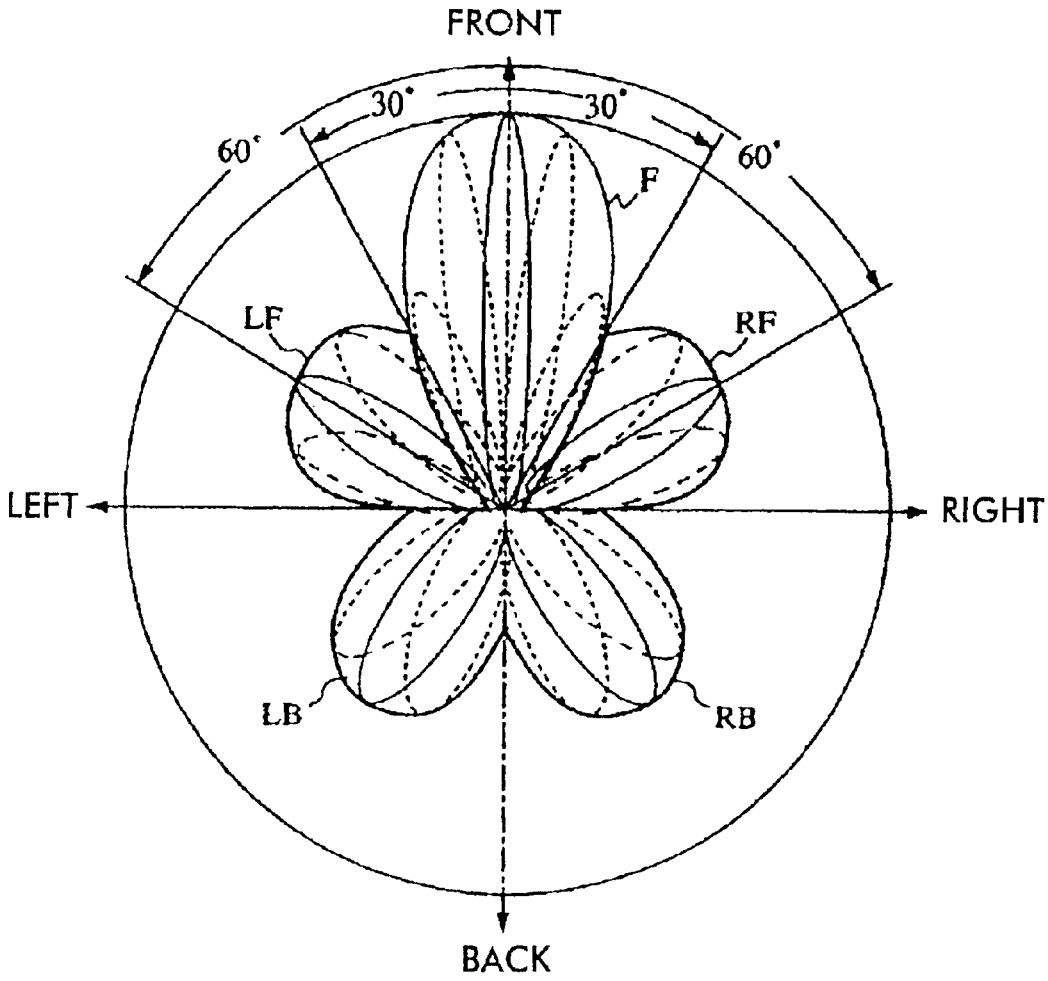
FIG. 14 illustrates the range of changes in beam directions obtained in a conventional antenna device and the antenna device according to the invention.

FIG. 14 shows an example of the range of beam-direction changes. In FIG. 14, a beam scanning range represented by the symbol F is the scanning range of a conventional art. In each of the first to fourth embodiments, in addition to the range F, there are provided scanning ranges represented by the symbols LF and RF.

Next, an antenna device according to a fifth embodiment of the invention will be described with reference to FIG. 7.

The antenna device of this embodiment does not include dielectric lenses. Additionally, a beam is formed in a direction opposing the direction of a beam radiated from the primary radiator. In FIG. 7, the reference numerals 34, 35, and 36 denote offset parabolic reflecting mirrors. When the beam radiated from the primary radiator 1 is Ba', the reflecting mirror 34 reflects and converges the beam to form a beam in a direction indicated by an arrow in the lower left direction in the figure. Similarly, when the beam radiated from the primary radiator 1 is Bc', the reflecting mirror 36 reflects and converges the beam to form a beam in a direction indicated by an arrow in the lower right direction in the figure.

The reflecting mirror 35 offsets such that the reflected waves of electromagnetic waves radiated from the primary radiator 1 can be radiated avoiding the proximity of the primary radiator 1. The reflecting mirrors 34 and 36 offset to allow reflected waves to be reflected in the lateral slanting directions.

Figure 7:
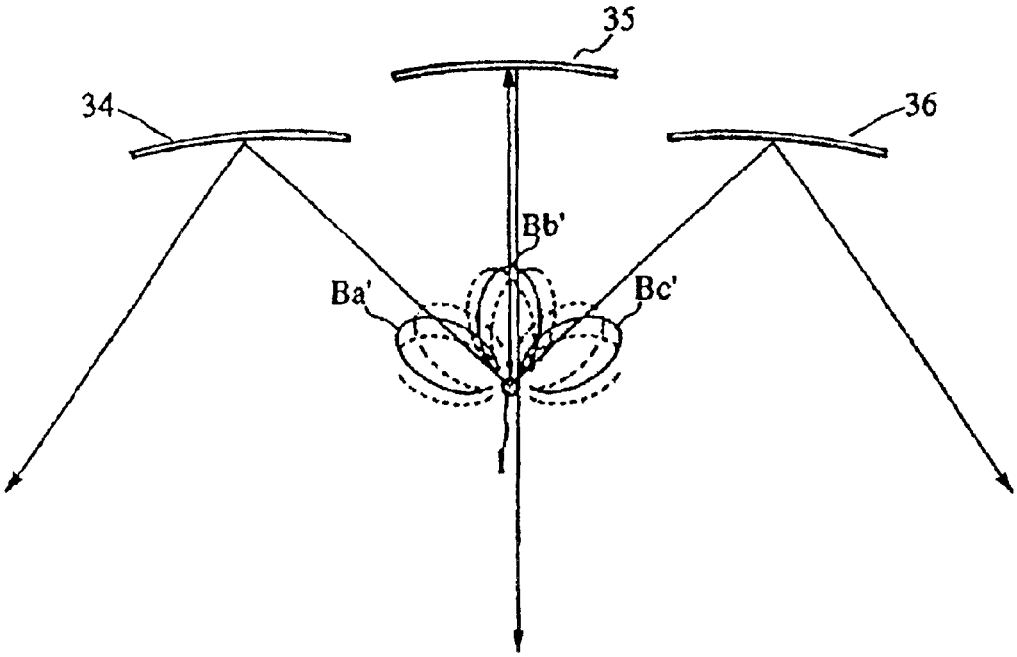
FIG. 7 illustrates an antenna device according to a fifth embodiment of the invention.

In the arrangement shown in FIG. 7, when beam scanning is performed using a single reflecting mirror in a predetermined angular range, as in the case shown in FIG. 6, the primary radiator 1 is rotationally displaced in the predetermined angular range.

In the fifth embodiment, the beam scanning range is extended to a range indicated by the symbols LB and RB shown in FIG. 14.

Figure 8:
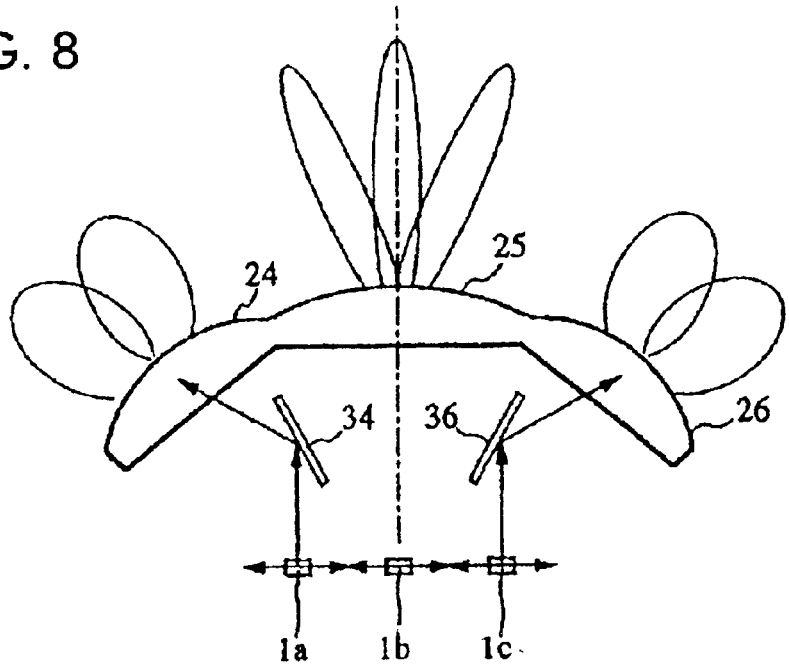
FIG. 8 illustrates an antenna device according to a sixth embodiment of the invention.

Next, an antenna device according to a sixth embodiment of the invention will be described with reference to FIG. 8.

This uses both dielectric lens and reflecting mirrors. Reflecting mirrors 34 and 36 are arranged between a primary radiator and dielectric lenses 24 and 26. The dielectric lenses 24, 25, and 26 are integrally resin-molded. When the primary radiator is positioned in a predetermined range with respect to the central position 1*b*, a beam from the primary radiator is emitted to the dielectric lens 25 and with the displacement of the primary radiator, as shown in FIG. 8, beam scanning can be made in a predetermined angular range including the forward area and its proximity. With the further displacement of the primary radiator, for example, when it is in the position 1*a*, the beam from the primary radiator is reflected by the reflecting mirror 34 to be emitted to the dielectric lens 24. As a result, a beam is formed in the direction of the central axis of the dielectric lens 24. When the primary radiator is displaced from the position 1*a* to the right and left over the predetermined range, energy distribution of electromagnetic waves reflected by the reflecting mirror 34 with respect to the dielectric lens 24 changes, and then, phase changes also occur. Consequently, the angle of the beam changes. Similarly, when the primary radiator is in the position 1*c*, a beam radiated from the primary radiator is reflected by the reflecting mirror 36 to be emitted to the dielectric lens 26. Consequently, a beam is formed in the central axial direction of the dielectric lens 26. When the primary radiator is displaced from the position 1*c* to the right and left over the predetermined range, the angle of the formed beam changes.

As mentioned above, the reflecting mirrors are arranged between the dielectric lenses and the primary radiator. With this arrangement, switching to the dielectric lens targeted for emitting a radiated beam according to the displacement of the primary radiator can be made with a little moving amount. Thus, the moving portion enabling the displacement of the primary radiator can be made compact and high-speed scanning can be performed. In addition, since the plurality of dielectric lenses is integrally formed, the assembly of dielectric lenses can be facilitated, improving the directional accuracy of each of the dielectric lenses.

The reflecting mirrors 34 and 36 may have, as alternative to planes, curved surfaces such as offset paraboloids.

Figure 9:
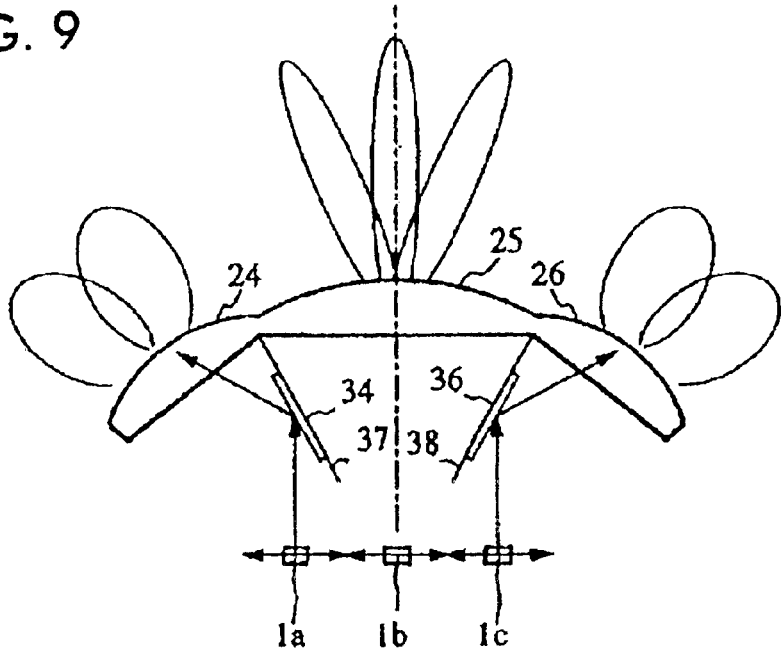
FIG. 9 illustrates an antenna device according to a seventh embodiment of the invention.

Next, an antenna device according to a seventh embodiment of the invention will be described with reference to FIG. 9. Unlike the antenna device shown in FIG. 8, there are arranged shielding members 37 and 38. For example, when the primary radiator is in the position 1*a*, the shielding members 37 and 38 prevent a beam from the primary radiator from being emitted to the dielectric lenses 25 and 26. Similarly, when the primary radiator is in the position 1*c*, the shielding members 37 and 38 prevent a beam from the primary radiator from being emitted to the dielectric lenses 24 and 25. In addition, when the primary radiator is in the position 1*b*, the shielding members 37 and 38 prevent a beam radiated from the primary radiator from being emitted to the dielectric lens 24 and 26. When the primary radiator is near the position 1*b*, the shielding members 37 and 38 prevent the radiated beam from being emitted to the dielectric lens 24 and 26. With this arrangement, no beam is formed in unnecessary directions. The shielding members 37 and 38 are also used to secure the reflecting mirrors 34 and 36.

Figure 10:
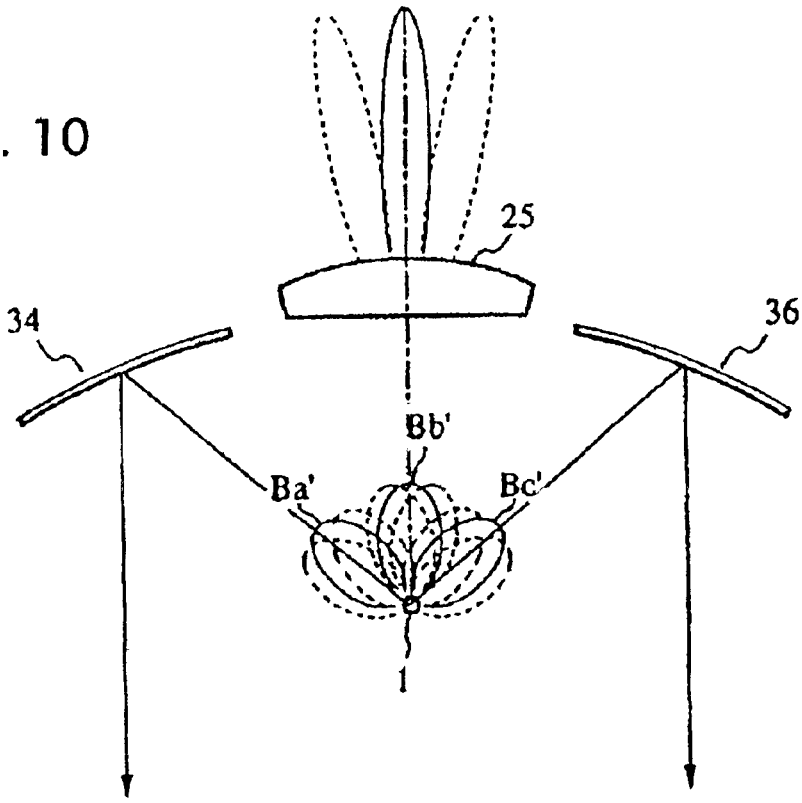
FIG. 10 illustrates an antenna device according to an eighth embodiment of the invention.

Next, an antenna device according to an eighth embodiment of the invention will be described with reference to FIG. 10.

Similar to the antenna device shown in FIG. 6, the antenna device of the eighth embodiment uses a dielectric lens 25 and reflecting mirrors 34 and 36 together. The reflecting mirrors 34 and 36 are oriented in directions different from the directions of the mirrors used in the antenna device shown in FIG. 6. In the range of rotational displacement of the primary radiator 1, in which a beam radiated from the primary radiator 1 is emitted to the dielectric lens 25, that is, when the beam from the primary radiator 1 is in the position Bb' and when the primary radiator 1 is rotationally displaced from the central position Bb' over a predetermined angular range, a beam is formed in the forward direction and its proximity. On the other hand, with the further rotational displacement of the primary radiator 1, when the radiated beam is emitted to one of the reflecting mirrors 34 and 36, a beam is formed in a direction indicated by an arrow in the figure, that is, in the backward direction. Thus, similarly in the backward direction, beam scanning can be performed by the rotational displacement of the primary radiator 1 over the predetermined angular range.

The above antenna device may be incorporated in a vehicle radar module to detect objects existing in a predetermined angular range in both the forward and backward directions.

Next, an antenna device and a radar module according to a ninth embodiment of the invention will be described with reference to FIG. 11.

Figure 11A:
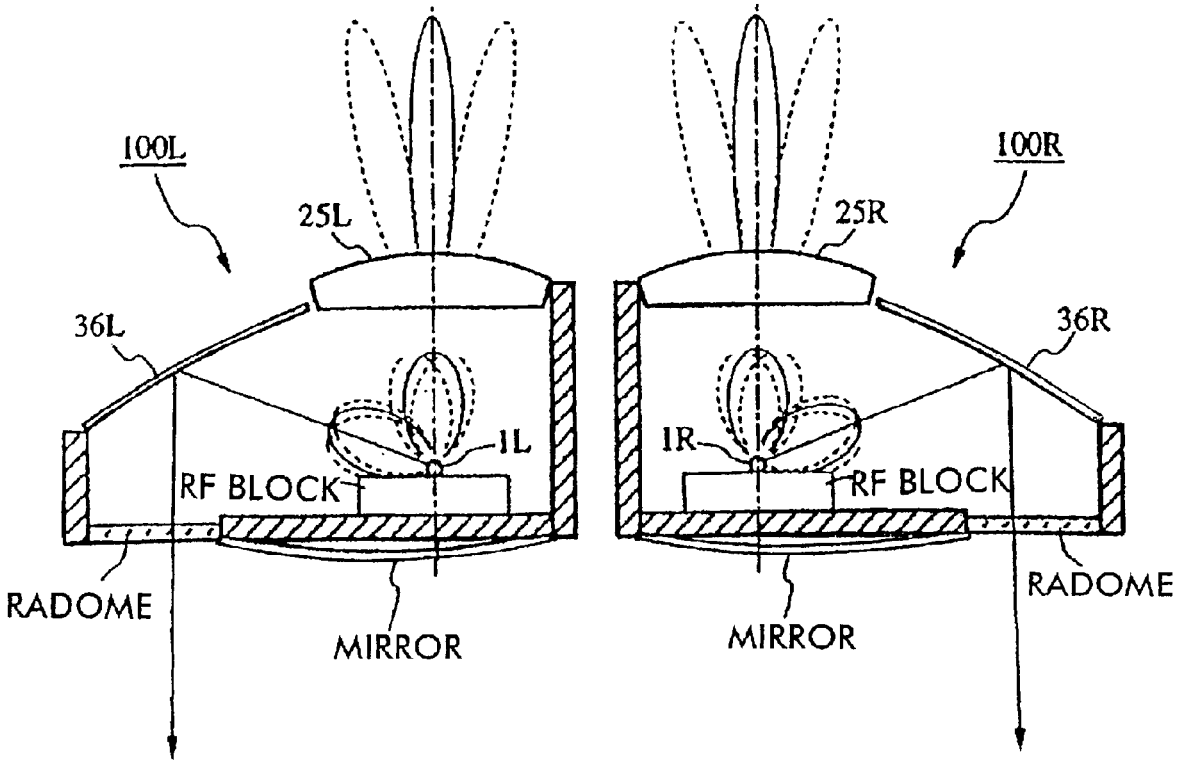
FIG. 11 illustrates an antenna device according to a ninth embodiment and a radar module using the antenna device.
Figure 11B:
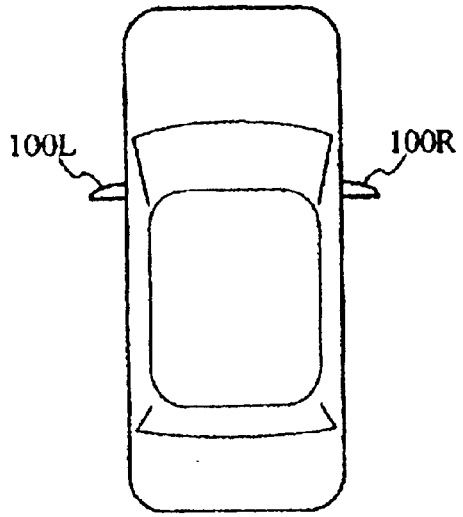

The radar module is incorporated in each of the door mirrors of a vehicle. In FIG. 11, the reference character 100L denotes the left door mirror and the reference character 100R denotes the right door mirror. FIG. 11A shows the inner structures of the door mirrors FIG. 11B shows the top view of the vehicle.

The antenna device uses dielectric lenses 25L and 25R for detecting in the forward direction and reflecting mirrors 36L and 36R for detecting in the backward direction. The antenna device uses both dielectric lenses and reflecting mirrors, as in the case of the antenna device shown in FIG. 10. In FIG. 11, the reference numerals 1L and 1R denote primary radiators. Beam scanning is performed according to the directions of beams radiated from the primary radiators. RF blocks are millimeter-wave radar modules and are connected to the controller of the vehicle.

With this arrangement, substantially, both the forward and backward directions of a vehicle can simultaneously be detected. In FIG. 11, each radome through which a backward detecting beam passes is disposed in a place in which a mirror itself incorporated in each door mirror is not arranged. However, when using a mirror reflecting visible light and transmitting millimeter waves, the mirror may be arranged on the entire region.

Next, a description will be given of an antenna device according to a tenth embodiment of the invention with reference to FIGS. 12A and 12B.

Figure 12A:
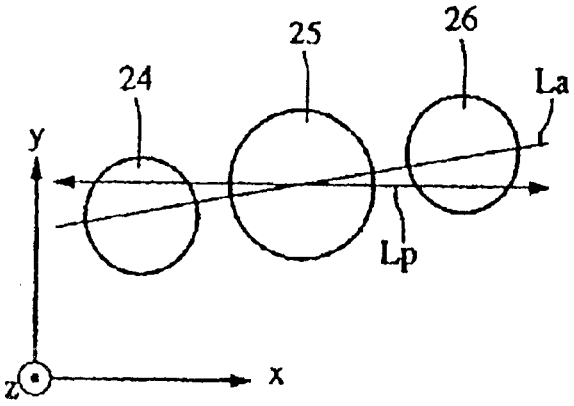
FIGS. 12A and 12B illustrate an antenna device according to a tenth embodiment of the invention.
Figure 12B:
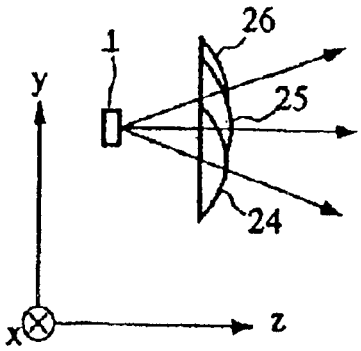

Each of FIGS. 12A and 12B illustrates the positional relationships between a primary radiator 1 and three dielectric lenses 24, 25, and 26. FIG. 12A is a front view on the front side of the dielectric lenses and FIG. 12B is a side view of them. The axis z indicates the front direction, the axis x indicates the horizontal direction orthogonal to the axis z, and the axis y indicates the vertical direction. The three dielectric lenses 24, 25, and 26 are arranged in such a manner that the axes of the lenses 24 to 26 are oriented in the direction of the axis z. A line La connecting the centers of the dielectric lenses is arranged not in parallel to a direction Lp in which the primary radiator is displaced. As a result, when the primary radiator 1 is displaced along the direction Lp, a beam direction determined by the positional relationships between the primary radiator 1 and the dielectric lenses 24, 25, and 26 is oriented not only in the x-axial direction but in the y-axial direction to scan. In other words, in a range in which the beam radiated from the primary radiator is emitted to the dielectric lens 25, beam scanning is performed along the x-axial direction. In a range in which the beam from the primary radiator 1 is emitted to the dielectric lens 24, beam scanning is performed in the x-axial direction while offsetting in the −y direction. Similarly, in a range in which the beam from the primary radiator 1 is emitted to the dielectric lens 26, beam scanning is performed in the x-axial direction while offsetting in the +y direction.

Next, an antenna device according to an eleventh embodiment of the invention will be described with reference to FIGS. 13A to 13C.

The entire structure of the antenna device including a primary radiator 1 and dielectric lenses 24, 25, and 26 is substantially the same as the structure of the antenna device shown in FIG. 1. However, an angular range for beam scanning used when the antenna device is applied to a radar module which will be described below can be switched in the eleventh embodiment. In other words, when a vehicle with a radar module runs at a high speed, the vehicle needs to detect a distant object in a more forward direction with a high resolution. Thus, as shown in FIG. 13A, the displacement of the primary radiator 1 is reduced to allow moving back and forth between the positions. With this arrangement, a beam is formed using mainly the dielectric lens 25.

In contrast, when running at a low speed, detection in lateral slanting directions is also required. Thus, as shown in FIG. 13C, the displacement of the primary radiator 1 is increased to allow a back-and-forth moving. As a result, with the use of the dielectric lenses 24, 25, and 26, beam scanning is performed over a wide angular range.

Figure 13A:
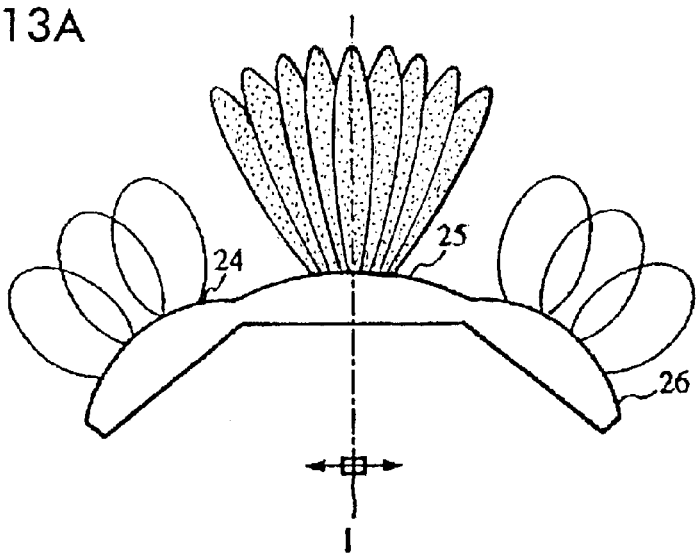
FIGS. 13A to 13C illustrate an antenna device according to an eleventh embodiment of the invention.
Figure 13B:
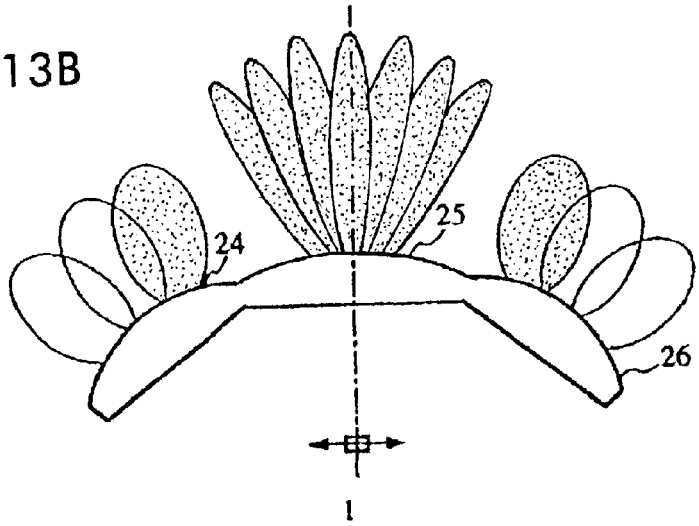
Figure 13C:
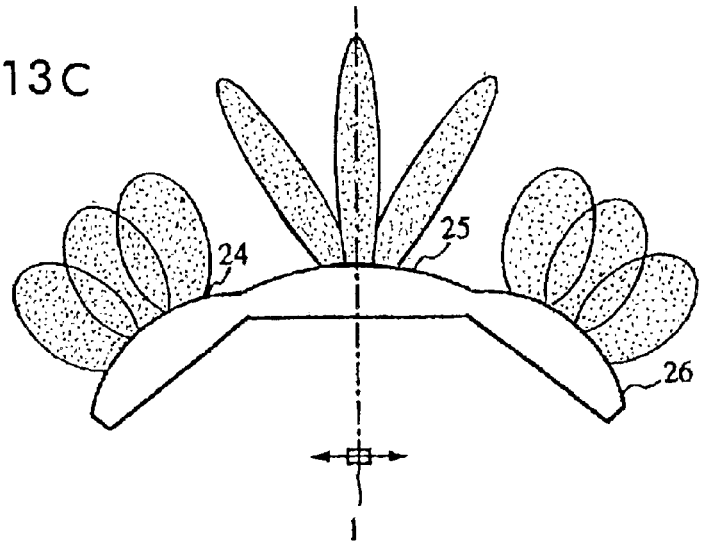

Furthermore, when running at an intermediate speed, as shown in FIG. 13B, although the dielectric lenses 24, and 26 are used setting the displacement of the primary radiator 1 to be between the displacements shown in FIGS. 13A and 13C, the beam scanning angular range of each lens is narrowed.

In the above embodiment, as the speed of the vehicle becomes higher, the displacement (the width of the back-and-forth moving) of the primary radiator is more reduced to control such that the ratio of a time in which electromagnetic waves radiated from the primary radiator are emitted to the dielectric lens 25 is greater than the ratio of a time in which the electromagnetic waves are emitted to each of the dielectric lenses 24 and 26. However, alternatively, even when making the displacement of the primary radiator constant, the same advantage can be obtained. In other words, when a vehicle runs at a low speed, the primary radiator moves back and forth substantially at a constant speed. As the speed of the vehicle becomes faster, the speed of the displacement of the primary radiator may be set to be slower near the central position in the to-and-fro movement, so that the ratio of a time in which the beam is oriented in the front (forward direction) may increase.

Figure 15:
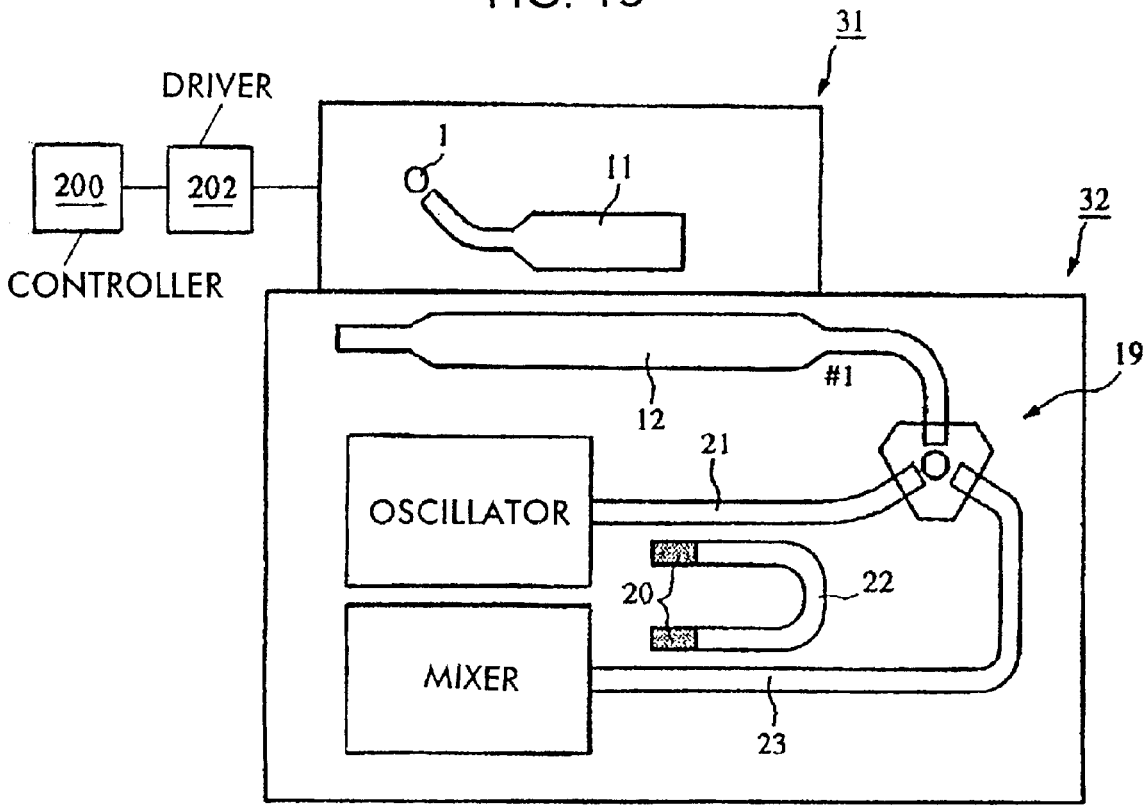
FIG. 15 illustrates a radar module according to a twelfth embodiment of the invention.
Figure 16:
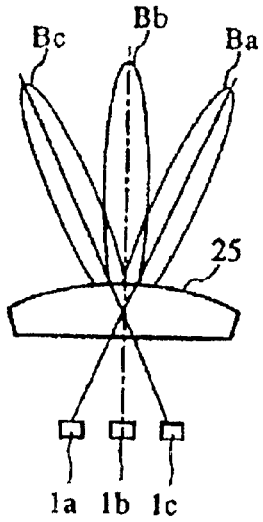
FIG. 16 PRIOR ART
FIG. 16 illustrates the conventional antenna device and the positional relationships between dielectric lenses and a primary radiator incorporated in the conventional antenna device.

Furthermore, the primary radiator may be displaced back and forth in a relatively narrow range so that even when the speed of the displacement of the primary radiator is maintained constant, electromagnetic waves radiated from the primary radiator can be mainly emitted to the front (central) dielectric lens 25. In addition, the width of the displacement of the primary radiator may be broadened in such manner that, for example, with a ratio of approximately one time per a few times of back-and-forth movements, the electromagnetic waves from the primary radiator can be emitted to the right and left dielectric lenses 24 and 26. Then, according to the speed of the vehicle, as the speed becomes faster, the ratio of a time necessary to use the central dielectric lens 25 may be increased, whereas the ratio of a time it takes to use the right and left dielectric lenses 24 and 26 may be decreased. In FIG. 15, to be described below, a controller 200 is shown which drives a driver 202, for example, the driver of FIG. 3 in a manner so as to be dependent on the on the vehicle speed, as discussed above.

Next, a radar module according to a twelfth embodiment of the invention will be described with reference to FIG. 15.

FIG. 15 shows a top view of the radar module, in which an upper conductive plate is removed. The structure of a directional coupler of a moving portion 31 and a fixed portion 32 are the same as those shown in FIG. 2. In this embodiment, a circulator 19 is connected to a port #1 used for inputting and outputting signals of the directional coupler, a hyper NRD guide formed by a dielectric strip 21 is connected to the input port of the circulator 19, and a hyper NRD guide formed by a dielectric strip 23 is connected to the output port of the circulator 19. An oscillator is connected to the hyper NRD guide formed by the dielectric strip 21 and a mixer is connected to the hyper NRD waveguide formed by the dielectric strip 23. Between the dielectric strips 21 and 23 there is arranged a dielectric strip 22 forming a directional coupler by coupling with each of the hyper NRD guides formed by the dielectric strips 21 and 23. At each end of the dielectric strip 22 there is arranged a terminator 20. Here, in each of the mixer and the oscillator formed by a NRD guide, there are arranged a varactor diode and a Gunn diode, with a substrate provided to dispose a circuit for applying bias voltages to the diodes.

With the above arrangement, an oscillation signal from the oscillator is transmitted to the dielectric strip 21, the circulator 19, the dielectric strip 12, the dielectric strip 11, and the primary radiator 1, sequentially. Then, electromagnetic waves are radiated in the axial direction of the primary radiator 1. In contrast, electromagnetic waves received by the primary radiator 1 are provided to the mixer through a route of the dielectric strip 11, the dielectric strip 12, the circulator 19, and the dielectric strip 23. In addition, via two directional couplers formed by the dielectric strips 21, 22, and 23, parts of oscillation signals are transmitted as local signals along with reception signals to the mixer. Consequently, as intermediate frequency signals, the mixer generates frequency components obtained from the difference between the transmission signals and the reception signals.

In the structure shown in FIG. 15, even if there are arranged directional couplers formed by the dielectric strips 21, 22, and 23, when a transmission circuit is arranged in the oscillator and a reception circuit is arranged in the mixer, a communication apparatus using a millimeter wave can be provided.

In each of the embodiments above, three dielectric lenses and/or three reflecting mirrors are arranged at maximum. However, the number of those components can be arbitrarily increased.

Furthermore, in some of the embodiments above, reflectors are arranged between the dielectric lenses and the primary reflector to control the directivity of the beam radiated from the primary radiator. However, between the dielectric lenses and the primary reflector, another dielectric lens or an optical transmitter such as a prism may be arranged to control the directivity of a beam.

As described above, the antenna device of the invention includes a primary radiator and openings controlling the directivity of a beam radiated from the primary radiator. The openings are formed in the fixed portion to separately emit electromagnetic waves radiated from the primary radiator and the primary radiator is arranged in the moving portion. The moving portion is displaced relatively with respect to the fixed portion to select each opening for receiving the electromagnetic waves from the primary radiator and to change the direction of the beam. Thus, with the use of the single primary radiator, detection can be made in a range in which it is difficult to detect with only one opening, and beam scanning can be performed at a high speed over a wide angular range.

In addition, in the antenna device according to the invention, when the openings are formed by dielectric lenses, the entire structure can be simplified, thereby facilitating the designing of the device.

In addition, when the openings are formed by dielectric lenses and reflectors arranged between the dielectric lenses and the primary radiator, the beam scanning angle with respect to the moving amount of the primary radiator can be easily broadened and the scanning speed can be increased.

In addition, when there is provided a unit for detecting the direction of a beam radiated from each of the openings, even with the use of the plurality of openings, the beam can be oriented in an arbitrary direction.

In addition, the line of the fixed portion is coupled to the line of the moving portion coupled to the primary radiator to form a directional coupler. As a result, coupling between the line of the fixed portion and the line of the moving portion can be facilitated.

In addition, when the lines of the fixed portion and the moving portion are formed by nonradiative dielectric lines, loss in the transmission of millimeter-wave band signals can be reduced and coupling with the primary radiator can be facilitated.

Furthermore, in this invention, the degree of coupling between the output side and the input side of the directional coupler is set to be substantially 0 dB. As a result, insertion loss due to the directional coupler formed between the line of the fixed portion and the line of the moving portion can be suppressed. Accordingly, since the gain of the antenna can be increased, a greater output power can be obtained.

In addition, shielding members may be arranged between at least two predetermined openings of the plurality of openings. With this arrangement, electromagnetic waves radiated from the primary radiator are emitted selectively only to predetermined openings. Thus, since the gap between the openings can be narrowed, the entire device can be made compact.

Furthermore, the line connecting the centers of the openings may not be parallel to the direction in which the primary radiator is displaced. As a result, with the linear displacement of the moving portion, three-dimensional beam scanning can be performed.

Furthermore, of the plurality of openings, the central opening may be set to be larger than the remaining openings. As a result, the gain and resolution of the antenna in the proximity of the central part can be higher. Moreover, with the use of the openings except the central opening, beam scanning can be made over a wide angular range, while reducing the size of the antenna device.

Furthermore, when the dielectric lenses are integrally formed over the plurality of openings, the assembly of the dielectric lenses can be made easily and the directional accuracy of each dielectric lens can be improved.

Furthermore, in this invention, there is provided a communication apparatus including the antenna device described above, a transmission circuit transmitting signals to the antenna device, and a reception circuit receiving reception signals from the antenna device. Thus, with the apparatus, communications can be made performing beam scanning over a wide angular range.

In addition, the invention provides a radar module in addition to the above antenna device. The radar module outputs a transmission signal to the antenna device and receives a reception signal from the antenna device to detect an object reflecting electromagnetic waves transmitted from the antenna device. Accordingly, detection of a targeted object can be performed at a high speed over a wide angular range.

Furthermore, in this invention, there may be arranged a unit for controlling the widths of the displacement of the openings in such a manner that when the speed of a moving object incorporating the radar module is faster than a predetermined speed, electromagnetic waves radiated from the primary radiator is emitted to mainly one of the openings, and when the moving speed is slower than the predetermined speed, the electromagnetic waves are emitted to plural openings. With this arrangement, efficient detection can be performed in an angular range appropriate according to the speed of the moving object.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An antenna device comprising:

a single primary radiator arranged on a moving portion;

a plurality of beam formation devices arranged on a fixed portion to receive electromagnetic waves radiated from the single primary radiator to control the directivities of generated beams;

a driver relatively displacing the moving portion with respect to the fixed portion to select each beam formation device appropriate for primarily receiving each of the electromagnetic waves and to change the directions of the beams; and a directional coupler formed by coupling a line arranged on the fixed portion to a line arranged on the moving portion and coupled to the single primary radiator.

2. The antenna device of claim 1, wherein the lines arranged on the fixed portion and the moving portion are nonradiative dielectric lines.

3. The antenna device of claim 1, wherein a degree of coupling between an input side and an output side in the directional coupler is substantially 0 dB.

4. An antenna device comprising:

a single primary radiator arranged on a moving portion;

a plurality of beam formation devices arranged on a fixed portion to receive electromagnetic waves radiated from the single primary radiator to control the directivities of generated beams; and a driver relatively displacing the moving portion with respect to the fixed portion to select each beam formation device appropriate for primarily receiving each of the electromagnetic waves and to change the directions of the beams, wherein the single primary radiator is moved linearly.

5. An antenna device comprising:

a single primary radiator arranged on a moving portion;

a plurality of beam formation devices arranged on a fixed portion to receive electromagnetic waves radiated from the single primary radiator to control the directivities of generated beams;

a driver relatively displacing the moving portion with respect to the fixed portion to select each beam formation device appropriate for primarily receiving each of the electromagnetic waves and to change the directions of the beams, wherein the antenna device is arranged in a rear view mirror of an automotive vehicle.

6. A radar module comprising:

an antenna device comprising:

a primary radiator arranged on a moving portion;

a plurality of beam formation devices arranged on a fixed portion to receive electromagnetic waves radiated from the primary radiator to control the directivities of generated beams; and a driver relatively displacing the moving portion with respect to the fixed portion to select each beam formation device appropriate for primarily receiving each of the electromagnetic waves and to change the directions of the beams; and further comprising:

a circuit outputting a transmission signal to the antenna device and receiving a reception signal from the antenna device to detect an object reflecting electromagnetic waves sent from the antenna device; and a controller controlling the displacement of the moving portion such that when the speed of a moving object having the radar module mounted therein is higher than a predetermined speed, an amount of time in which the electromagnetic wave radiated from the primary radiator is transmitted to a selected beam formation device related to a direction in which the moving object travels, is greater than an amount of time in which the electromagnetic wave is transmitted to each of the remaining beam formation devices.

7. A radar module comprising:

an antenna device comprising:

a primary radiator arranged on a moving portion;

a plurality of beam formation devices arranged on a fixed portion to receive electromagnetic waves radiated from the primary radiator to control the directivities of generated beams; and a driver relatively displacing the moving portion with respect to the fixed portion to select each beam formation device appropriate for primarily receiving each of the electromagnetic waves and to change the directions of the beams; and further comprising:

a circuit outputting a transmission signal to the antenna device and receiving a reception signal from the antenna device to detect an object reflecting electromagnetic waves sent from the antenna device; and a controller controlling the displacement of the moving portion such that as the speed of a moving object having the radar module mounted therein increases, the speed of the displacement of the primary radiator is set to be slower near a central position corresponding to a center beam formation device, so that a ratio of time in which the beam is emitted in a forward direction increases.

8. A radar module comprising:

an antenna device comprising:

a primary radiator arranged on a moving portion;

a plurality of beam formation devices arranged on a fixed portion to receive electromagnetic waves radiated from the primary radiator to control the directivities of generated beams; and a driver relatively displacing the moving portion with respect to the fixed portion to select each beam formation device appropriate for primarily receiving each of the electromagnetic waves and to change the directions of the beams; and further comprising:

a circuit outputting a transmission signal to the antenna device and receiving a reception signal from the antenna device to detect an object reflecting electromagnetic waves sent from the antenna device; and a controller controlling the displacement of the moving portion such that when the speed of a moving object incorporating the radar module is faster than a predetermined speed, electromagnetic waves radiated from the primary radiator are emitted to mainly one of the beam formation devices, and when the moving speed is slower than the predetermined speed, the electromagnetic waves are emitted to plural beam formation devices.

9. A radar module comprising:

an antenna device comprising:

a primary radiator arranged on a moving portion;

a plurality of beam formation devices arranged on a fixed portion to receive electromagnetic waves radiated from the primary radiator to control the directivities of generated beams; and a driver relatively displacing the moving portion with respect to the fixed portion to select each beam formation device appropriate for primarily receiving each of the electromagnetic waves and to change the directions of the beams; and further comprising:

a circuit outputting a transmission signal to the antenna device and receiving a reception signal from the antenna device to detect an object reflecting electromagnetic waves sent from the antenna device, wherein the moving portion has a cycle in which the electromagnetic wave is transmitted to all the beam formation devices, and further comprising a controller controlling the displacement of the moving portion such that when the speed of a moving object having the radar module mounted therein is higher than a predetermined speed, a ratio of a time in which the electromagnetic wave radiated from the primary radiator is transmitted to a beam formation device directed in a direction in which the moving object travels, to the time for the cycle, is greater than a ratio of a time in which the electromagnetic wave is transmitted to each of the remaining beam formation devices to the time for a cycle.

* * * * *